US009254429B1

(12) United States Patent
Gilman

(10) Patent No.: US 9,254,429 B1
(45) Date of Patent: Feb. 9, 2016

(54) APPARATUS FOR FOOTBALL TRAINING

(71) Applicant: Marty Gilman, Inc., Gilman, CT (US)

(72) Inventor: Neil F. Gilman, Gilman, CT (US)

(73) Assignee: MARTY GILMAN, INC., Gilman, CT (US)

( * ) Notice: Subject to any disclaimer, the term of this patent is extended or adjusted under 35 U.S.C. 154(b) by 0 days.

(21) Appl. No.: 14/688,690

(22) Filed: Apr. 16, 2015

(51) Int. Cl.
*A63B 69/34* (2006.01)

(52) U.S. Cl.
CPC ..... *A63B 69/345* (2013.01)

(58) Field of Classification Search
CPC ..... A63B 69/34
USPC ..... 473/440–445; D21/680; 2/2.5, 462, 2/463, 94, 461
See application file for complete search history.

(56) References Cited

U.S. PATENT DOCUMENTS

| | | | | | |
|---|---|---|---|---|---|
| 817,656 | A | * | 4/1906 | McCalla | 2/462 |
| 1,862,441 | A | * | 6/1932 | Till | 2/462 |
| 1,970,130 | A | * | 8/1934 | Dickenson | 2/462 |
| 2,037,508 | A | | 4/1936 | Gilman | |
| 2,203,259 | A | | 6/1940 | Gilman | |
| 2,237,599 | A | | 4/1941 | Gilman | |
| 2,237,600 | A | | 4/1941 | Gilman | |
| 2,239,223 | A | | 4/1941 | Gilman | |
| 2,449,935 | A | | 9/1948 | Gilman | |
| 2,526,217 | A | | 10/1950 | Gilman | |
| 2,937,872 | A | | 5/1960 | Gilman | |
| 3,891,996 | A | * | 7/1975 | Leach et al. | 2/2.5 |
| D259,052 | S | | 4/1981 | Gilman | |
| D313,638 | S | | 1/1991 | Gilman | |
| 5,329,636 | A | * | 7/1994 | Siddle | 2/463 |
| 5,433,438 | A | | 7/1995 | Gilman | |
| 5,501,649 | A | * | 3/1996 | Queppet | 482/88 |
| 5,581,815 | A | * | 12/1996 | Hans | 2/244 |
| 5,623,729 | A | * | 4/1997 | Chen | 2/461 |
| 5,652,967 | A | * | 8/1997 | Hsu | 2/463 |
| 6,036,609 | A | | 3/2000 | Gilman | |
| 6,261,194 | B1 | * | 7/2001 | Hadar et al. | 473/441 |
| 6,519,782 | B2 | * | 2/2003 | Collins et al. | 2/463 |
| 7,056,238 | B1 | * | 6/2006 | Brown | 473/444 |
| 7,727,089 | B2 | | 6/2010 | Gilman | |
| 7,739,753 | B2 | * | 6/2010 | Jankowski | 2/463 |
| 7,955,223 | B1 | | 6/2011 | Gilman | |
| 7,972,224 | B2 | | 7/2011 | Gilman | |
| 8,360,938 | B2 | | 1/2013 | Gilman | |

(Continued)

OTHER PUBLICATIONS

Webpage download, Rogersathletic2011 ,2011, www.rogersathletic.com/football/dummies_and_shields/shields.asp?pid=171, 1page.*

*Primary Examiner* — Gene Kim
*Assistant Examiner* — Michael Chambers
(74) *Attorney, Agent, or Firm* — Day Pitney LLP

(57) ABSTRACT

The present disclosure provides a training apparatus for developing fundamental skill for the game of football which comprises a base pad having at least one of a hand grip and a shoulder pad, and an outer pad mounted and securely stitched to a front of the base pad. The outer pad includes a torso region and a shoulder region shaped to mimic shoulder pads of a football player. In some embodiments, the outer pad is covered with a grippable mesh material adapted to mimic a texture and form of a football jersey. The outer pad may be smaller than and fit within a perimeter of the front of the base pad, and during training, the outer pad is adapted to draw attention to the center of the training apparatus to draw hands of a training player inside the perimeter of the base pad.

16 Claims, 10 Drawing Sheets

(56) References Cited

U.S. PATENT DOCUMENTS

D678,443 S 3/2013 Jordan
D678,444 S 3/2013 Jordan
8,617,007 B2 12/2013 Gilman

* cited by examiner

600

APPARATUS FOR FOOTBALL TRAINING

FIELD OF THE DISCLOSURE

The present disclosure relates to athletics training, and in particular, relates to an apparatus for use in training football players in blocking and tackling techniques.

BACKGROUND

Football training involves the use of various training equipment for developing different types of skills required in the game. However, the rules and style of play of football have changed over time, requiring advances in training techniques and equipment. A good example of such a change is in blocking and tackling. Now, football players are taught to upwardly drive their hands into the opposing lineman's armpits and to grab hold of their opponent in order to restrain the opposing lineman's motion, such as to avoid opening a hole in the defender's line, and to hopefully create a hole in the opposing line. As such, the skills of the lineman are absolutely critical to the success of a team. Applicant has found that the available training devices are not effective in training for blocking and tackling for the modern game.

SUMMARY OF THE DISCLOSURE

Applicant has concluded that, in order to overcome the aforementioned deficiencies in the art, what is needed is a football training apparatus that realistically simulates the gripping sites on an opposing lineman, enabling players to more realistically perform blocking and tackling techniques, thus translating into better game performance.

The present disclosure provides a training apparatus for developing such fundamental skills, that includes a base pad having at least one of a hand grip and a shoulder pad, and an outer pad mounted and securely stitched to a front of the base pad. The outer pad, that faces the practicing lineman, includes a torso region and a shoulder region shaped to mimic the shoulder pads and armpit location of a football player. The practicing lineman thus uses the armpit location as a "target" location for their hands when springing up and grabbing the pad. The pad further can include indicia, such as numbers, on the outer pad to also act as a target location for a practicing lineman.

In some embodiments, the outer pad is covered with a grippable mesh material adapted to mimic a texture and form of a football jersey. The outer pad may be smaller than and fit within a perimeter of the front of the base pad, and during training, the outer pad is adapted to draw attention to the center of the training apparatus to draw hands of a training player inside the perimeter of the base pad, such as with the use of player numbers in the middle of the pad.

BRIEF DESCRIPTION OF THE FIGURES

The provided figures, which are not limiting, illustrate the disclosed embodiments, in which.

DETAILED DESCRIPTION OF THE DISCLOSED EMBODIMENTS

According to the present disclosure, embodiments of an apparatus for training fundamental football skills are provided which enable improved practice of blocking and tackling techniques. Embodiments of the apparatus can serve as a practice 'dummy' upon which players may practice their blocking and tackling technique, and in particular, practice hand placement for optimal blocking and tackling. The apparatus includes a 'double-decker' pad configuration in which a first supporting pad provides bulk and mass and also provides a platform on which to securely support a second, outer pad that faces a practicing lineman during a drill. The outer pad includes shoulder and torso regions that mimic the corresponding regions of a football player, and also may include a covering that simulates the grippable texture of a football uniform jersey, which players are trained to target on opposing players for blocking and tackling. More specifically, the apparatus helps train players to use the proper technique of 'shooting up' from a crouched position with their hands narrowly spaced and in a thumbs-up orientation, in order to block or tackle a facing player. Using this technique, as the player attempting a block or tackle propels forward and upwards from the crouching position his hands naturally move into a suitable position for targeting the sides and armpit regions of the facing player. Using the apparatus according to the present disclosure, the player is trained in this maneuver to be in a position to grab onto the outer pad at or near where the torso and shoulder regions of the outer pad meet, at an 'armpit' region at the end of a 'shoot up' blocking or tackling maneuver. Repeated drilling and practice enables players to rapidly lock onto the armpit regions of opposing players' jerseys, enabling effective blocking and tackling technique. The pad can optionally include visual indicia, such as player numbers at the center of the outer pad, to help the practicing lineman to orient himself and "aim" for the proper target location (e.g., armpit region).

As the description below with respect to the figures makes clear, in a first embodiment, the apparatus comprises a "Fit Pad" device having a supporting pad of relatively large size that is adapted to be fitted onto a training sled. According to another embodiment, the apparatus comprises a "Fit Shield" device having a supporting pad of relatively smaller size adapted to be worn by a player (e.g., during practice).

Figure 1:
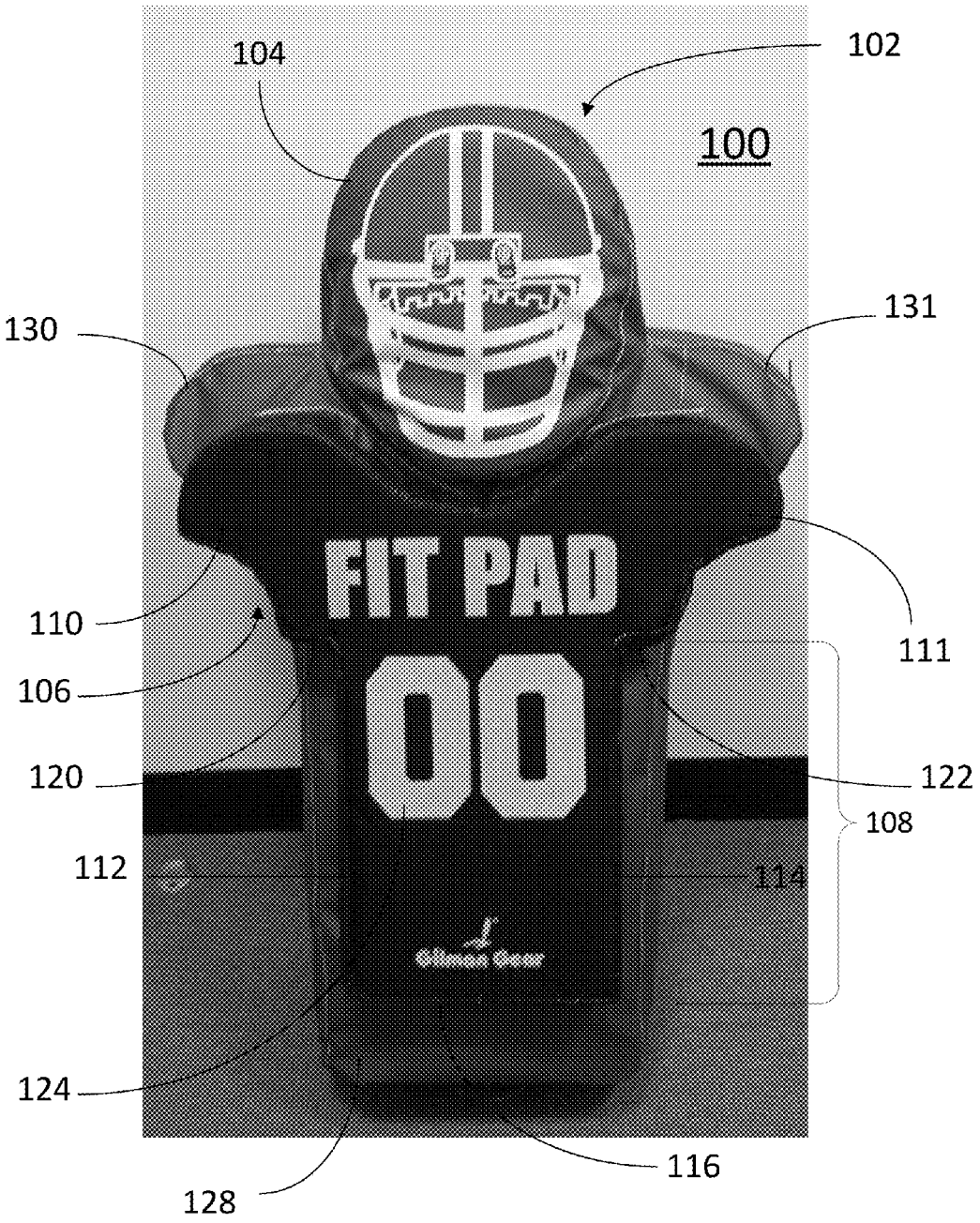
FIG. 1 illustrates a frontal view of an embodiment of the training apparatus of the present disclosure.

Turning to the figures, FIG. 1 is a frontal view of a first embodiment of the football training apparatus 100 of the present disclosure hereinafter referred to as the "Fit Pad" device. The "Fit Pad" device 100 includes a base pad 102 shown with a covering 104 to which an outer pad 106 is securely mounted and fastened. The outer pad 106 may comprise a water-resistant foam material, such as a closed-cell polyurethane foam, shaped to from a torso region 108 and shoulder regions 110, 111, mimicking the shape of the torso and shoulders of a football player. The outer pad 106 is covered with a strong and grippable material such as a fiber mesh. The mesh material is selected to have high tensile strength and abrasion resistance so as to withstand repeated stresses such as grabbing, pulling, shearing, etc. to which it is intended to be repeatedly subjected. According to one particular embodiment, the mesh material may comprise a vinyl coated polyester 16×16 scrim mesh of a woven fabric of cross-hatched fibers, having a tensile strength of between 300 and 400 lbs. warp, and between 300 and 350 lbs. fill, burst strength of between 600 and 700 psi, and puncture strength of between 50 and 150 pounds, according to standard ASTM measurement criteria. However, it is noted this is merely one possible suitable material to use for the covering of the outer pad 106 and that other materials, or similar materials with different specifications can be used depending on the training application. In some embodiments, the mesh material may also have useful air-permeability and ultraviolet radiation (UV) resistance, to allow the inner foam material to breathe (release moisture) and also to prevent degradation of the mesh due to excessive solar radiation exposure.

The torso region 108 may be approximately rectangular in shape, and it may have straight sides 112, 114 or the sides may taper toward a bottom edge 116. In some embodiments, the torso region 108 may measure between 15 and 20 inches from top to bottom, and from 7 to 11 inches from side to side. The shoulder regions 110, 111 may extend laterally outwards approximately 4 to 7 inches from an upper portion of the torso region 108, extending approximately 18 to 22 inches from wing to wing. It is however noted that these dimensions are exemplary and that the outer pad may be formed in larger or smaller sizes. The lower portion of shoulder regions 110, 111 form horizontal ledges 120, 122 adjacent to the sides 112, 114 of the torso region 108. The ledges 120, 122 correspond to armpits of a football player and are considered targets at which players are trained to aim during blocking and tackling exercises.

In some embodiments, various indicia may be printed, stitched on, or otherwise fastened to the outer pad 106 to provide easily-recognizable visual landmarks 124 for players to spot quickly. Examples of such visual landmarks 124 may include printed jersey numbers and team names, shoulder epaulets, armpit regions, deltoids, and a narrow torso. These visual landmarks 124 help the player align in a proper position to begin a blocking or tackling maneuver.

Base pad 102 may comprise a high-density foam material, such as a polyurethane, that is resistant to deformation. In the depicted embodiment, base pad 102 is, like the outer pad 106, formed to mimic the upper body of a football player with respective torso 128 and shoulder regions 130, 131. However, this is not necessary and the base pad 102 can be formed in a variety of different shapes. In some embodiments, dimensions of the base pad 102 are larger than those of the outer pad 106 such that, from the frontal view, the frontal profile of base pad 102 surrounds and subsumes the frontal profile (perimeter) of outer pad 106. For example, in the depicted embodiment in which the base pad mimic the shape of the upper body of a football player, the torso 128 of the base pad may be approximately 33 to 37 inches long and the span of the shoulder region 22 to 25 inches wide. The covering 104 of base pad 102 is preferably made of a non-grippable (low-friction) surface that is also water-resistant.

Figure 2:
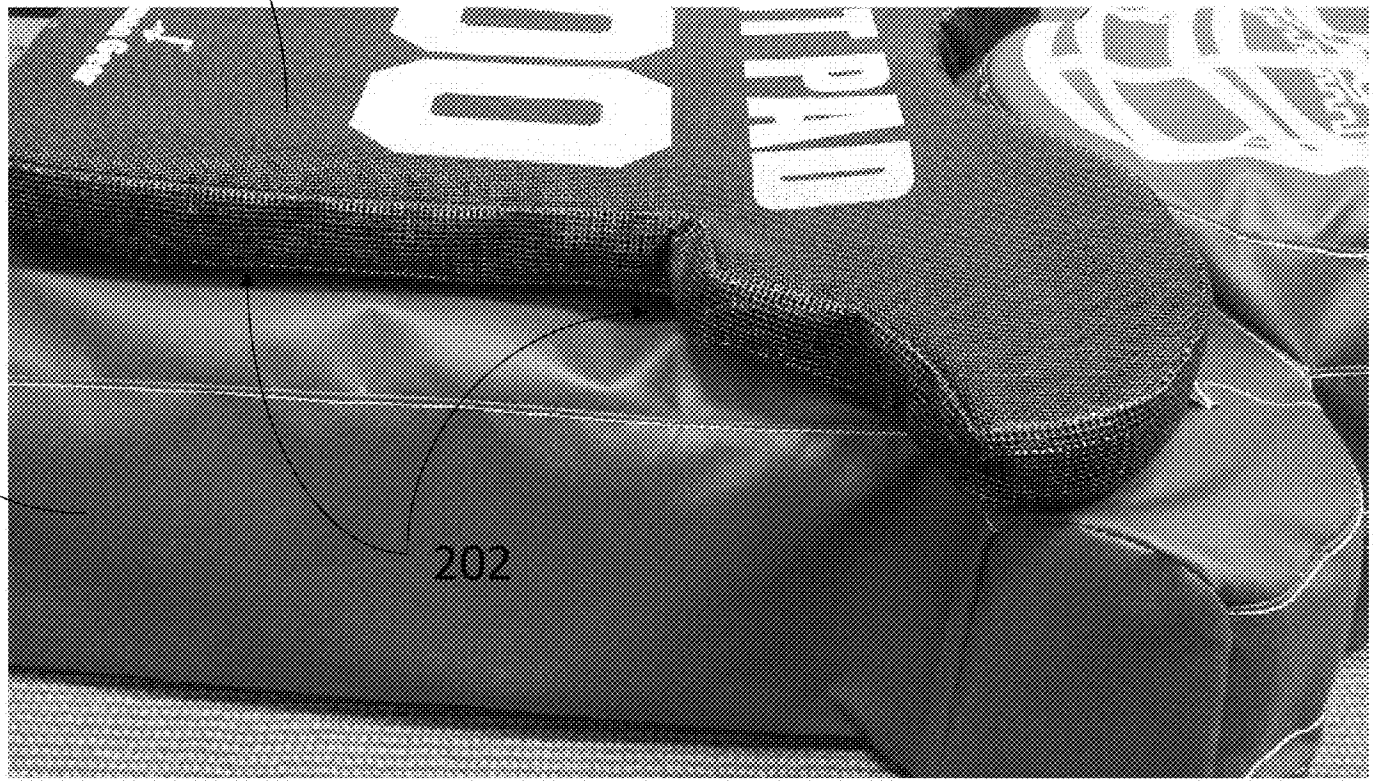
FIG. 2 illustrates a side view of an embodiment of the training apparatus of the present disclosure.

FIG. 2 shows a partial side view of the embodiment of the Fit Pad device 100 shown in FIG. 1. In this view the respective thicknesses of the base pad 102 and the outer pad 106 can be clearly discerned. In some embodiments, the thickness of the foam layer of the base pad 102 can be set to provide a base pad thickness of approximately 3.0 to 6.0 inches. The outer pad 106 typically has a smaller thickness of approximately 0.05 to 3 inches, to mimic a thickness of a football jersey, for example. In some embodiments, the covering of the outer pad 106 is stitched to the covering 104 of the base pad toward the center of the back of the outer pad (not shown) in a manner that allows a crease 202 (shown in shadow in FIG. 2) to be formed between the base pad 102 and outer pad 106. In a blocking or tackling exercise, the crease 202 enables a player to curl their fingers around the back of the outer pad for gripping as described more fully below. In some embodiments, the crease 202 may be between 0.75 and 3.25 inches in thickness, providing sufficient space for players to curl their fingers around the back of the outer pad 106.

Figure 3:
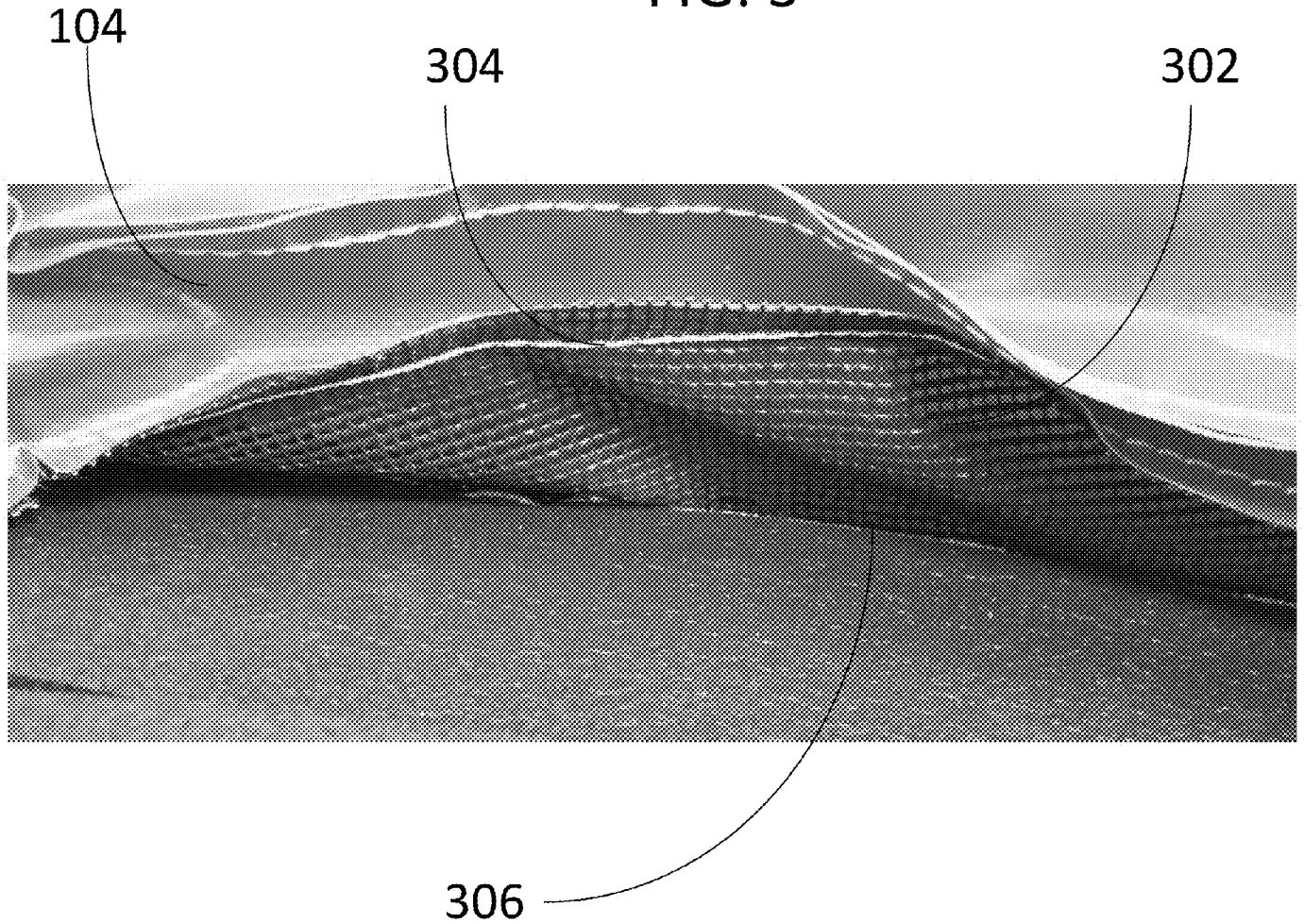
FIG. 3 illustrates a view of the back of an outer pad of the training apparatus illustrating an example implementation in which the coverings of the base and outer pads are coupled via stitches.

FIG. 3 shows a view of the back of an outer pad of the Fit Pad device according to an embodiment of the present disclosure illustrating an example implementation in which the coverings of the base and outer pads 102, 106 are coupled via stitches. As shown, the covering of the base pad 104 is securely coupled to the mesh covering 302 of the outer pad via two longitudinal stitches 304, 306. It is noted that this is merely one implementation, and that different stitches may be used, and/or different mechanisms, such as staples, adhesives, knots, etc. may be used to securely couple the mesh covering 302 with the base pad covering 104.

Figure 4:
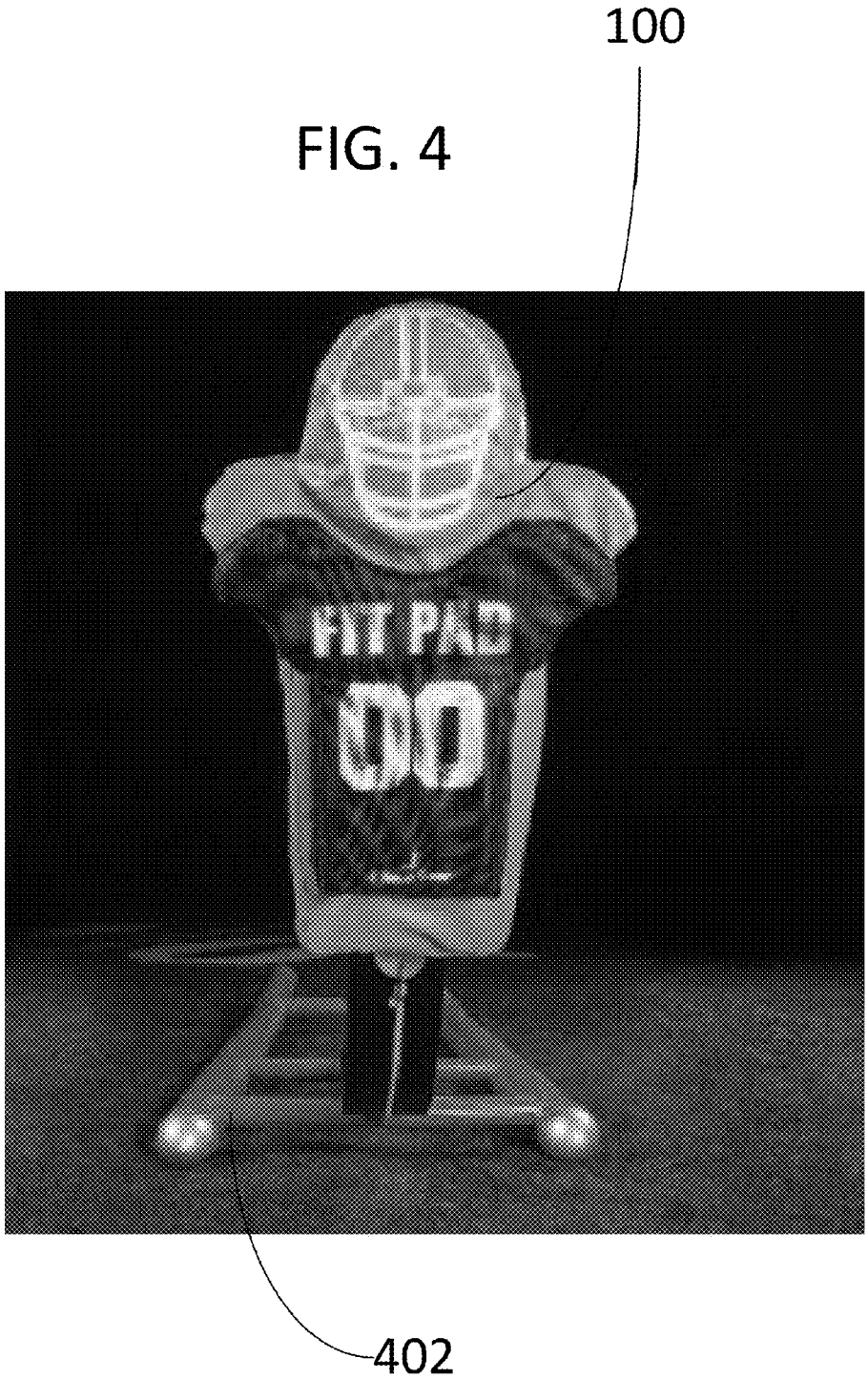
FIG. 4 illustrates a front view of an embodiment of the training apparatus according to the present disclosure coupled to a training sled.
Figure 5:
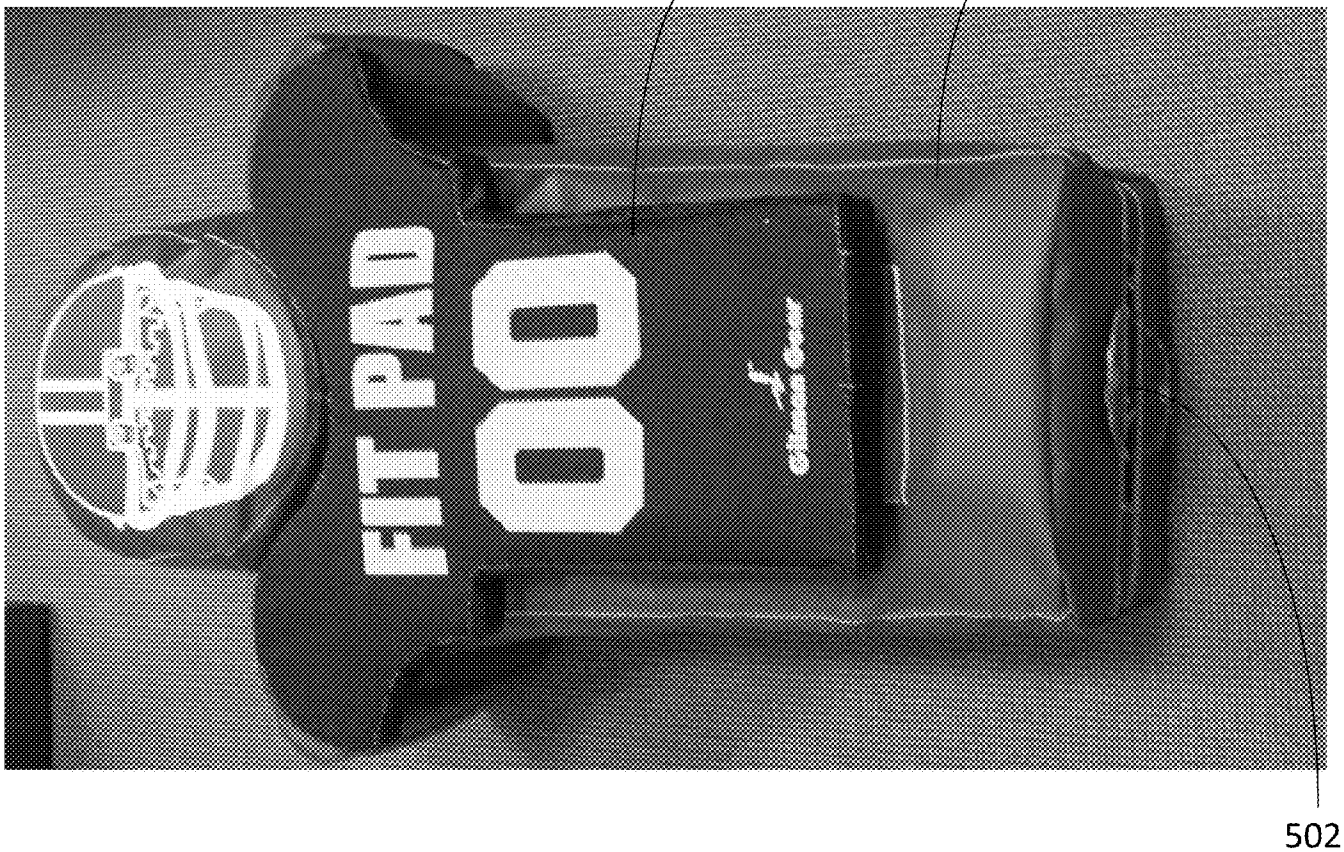
FIG. 5 illustrates a perspective view of an embodiment of the training apparatus according to the present disclosure.

The Fit Pad device 100 is adapted to be coupled to a training sled in an upright position. An example of the this is shown in FIG. 4, which is a front view showing a Fit Pad device 100 according to an embodiment of the present disclosure coupled to a training sled 402. In practice sessions, the Fit Pad device may act as a 'dummy' of an opposing football player and players in training may attempt blocking and tackling technique on the Fit Pad device 100, and when a grip on the Fit Pad device has been obtained, the players may push the training sled backwards, exerting a corresponding force as if they were attempting push back an opposing football player. FIG. 5 is perspective view of an embodiment of the Fit Pad device too according to the present disclosure showing a bottom coupling slot 502 on the base pad 102 where the Fit Pad device may be attached to a mating fixture on a training sled such as a flat leaf spring. However, it is noted that the Fit Pad device can be securely coupled to a training sled in a number of other ways. In addition, the Fit Pad device too may have hand grips or straps on the back of the base pad 102 allowing players hold onto the pad.

Figure 6:
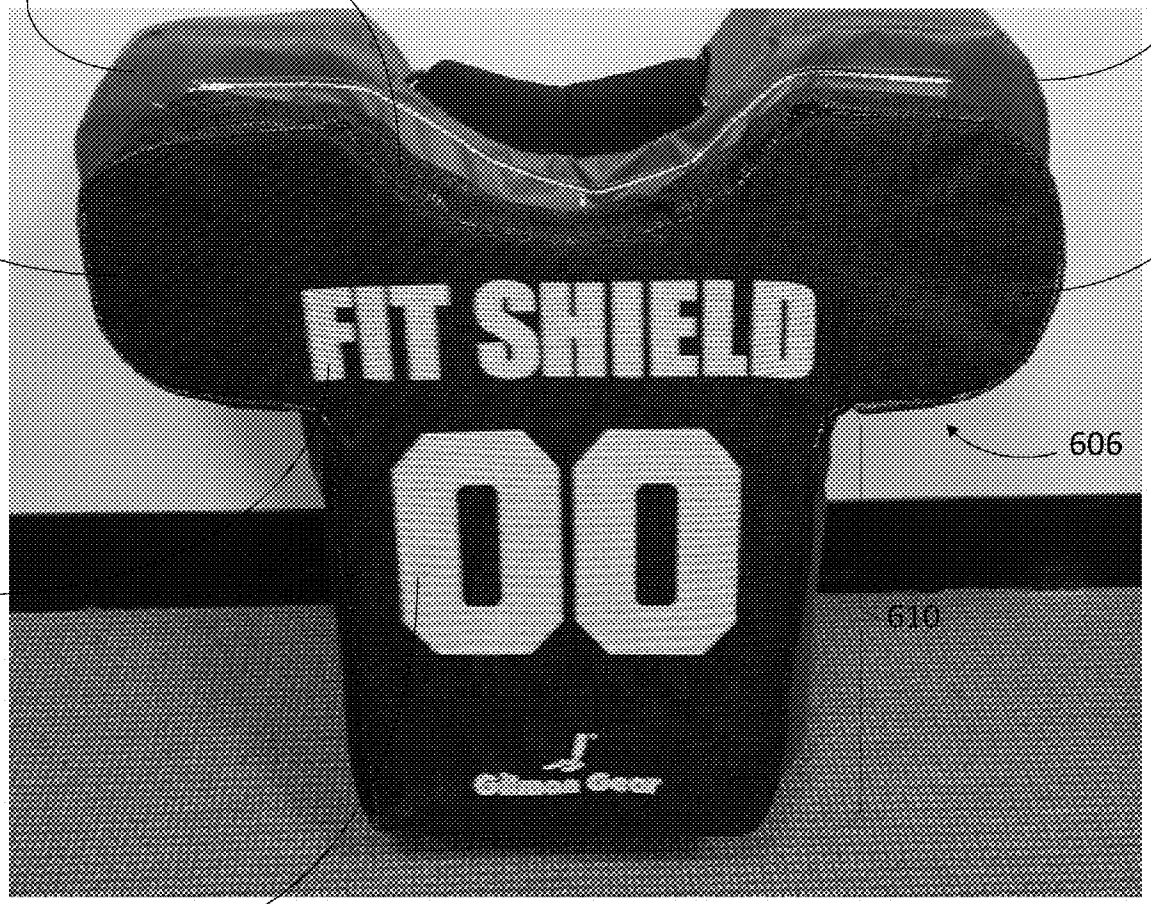
FIG. 6 illustrates a frontal view of another embodiment of the training apparatus according to the present disclosure.

FIG. 6 is a frontal view of a second embodiment of the football training apparatus 600 of the present disclosure hereinafter referred to as the "Fit Shield" device. The Fit Shield device **60*o* also includes a base pad 602 with a covering 604, to which an outer pad 606 with covering 608 is securely mounted and fastened. The outer pad 606 similarly comprises a foam shaped so as to mimic the upper body of a football player, including a torso region 610, and shoulder regions 612, 614. Visual landmarks such as a number 62*o* and a name 622 may be printed on the torso region 610 of the outer pad. As depicted, the base pad 602 is also formed so as to mimic a football player with corresponding torso and shoulder regions but this is not necessary and the base pad may be formed in a variety of shapes. The frontal dimensions of the outer pad 606 are smaller than the front dimensions of the base pad 602 such that the perimeter of the outer pad appears to surrounded by the base pad. In the Fit Shield device 600, the torso region 610** of the outer pad 606 may be smaller than the torso region of the Fit Pad device, and in some embodiments may measure, for example, between 9 and 12 inches in length. In contrast, the shoulder regions 612, 614 may be similar in size to the corresponding shoulder regions of the Fit Pad device, and in some embodiments may extend laterally 4 to 7 inches from the torso region, and measure 18 to 22 inches wing to wing. It is however noted that these dimensions are exemplary and that the outer pad may be formed in larger or smaller sizes. The torso region of the base pad 602 in the Fit Shield device may also be smaller than in the Fit Pad device, in proportion to the torso region of the outer pad. The base pad 602 may be formed using a high-density foam that is resistant to deformation, such as a polyurethane, and the covering of the base pad 604 may be a non-grippable and water resistant material, such as a vinyl. The outer pad 606 may be formed using a water-resistant foam material, such as a closed-cell polyurethane, and the outer pad covering 608 may be a mesh material similar to that described above with respect to the mesh material of the Fit Pad device, a grippable material having high tensile strength and abrasion resistance, among other useful properties.

Figure 7:
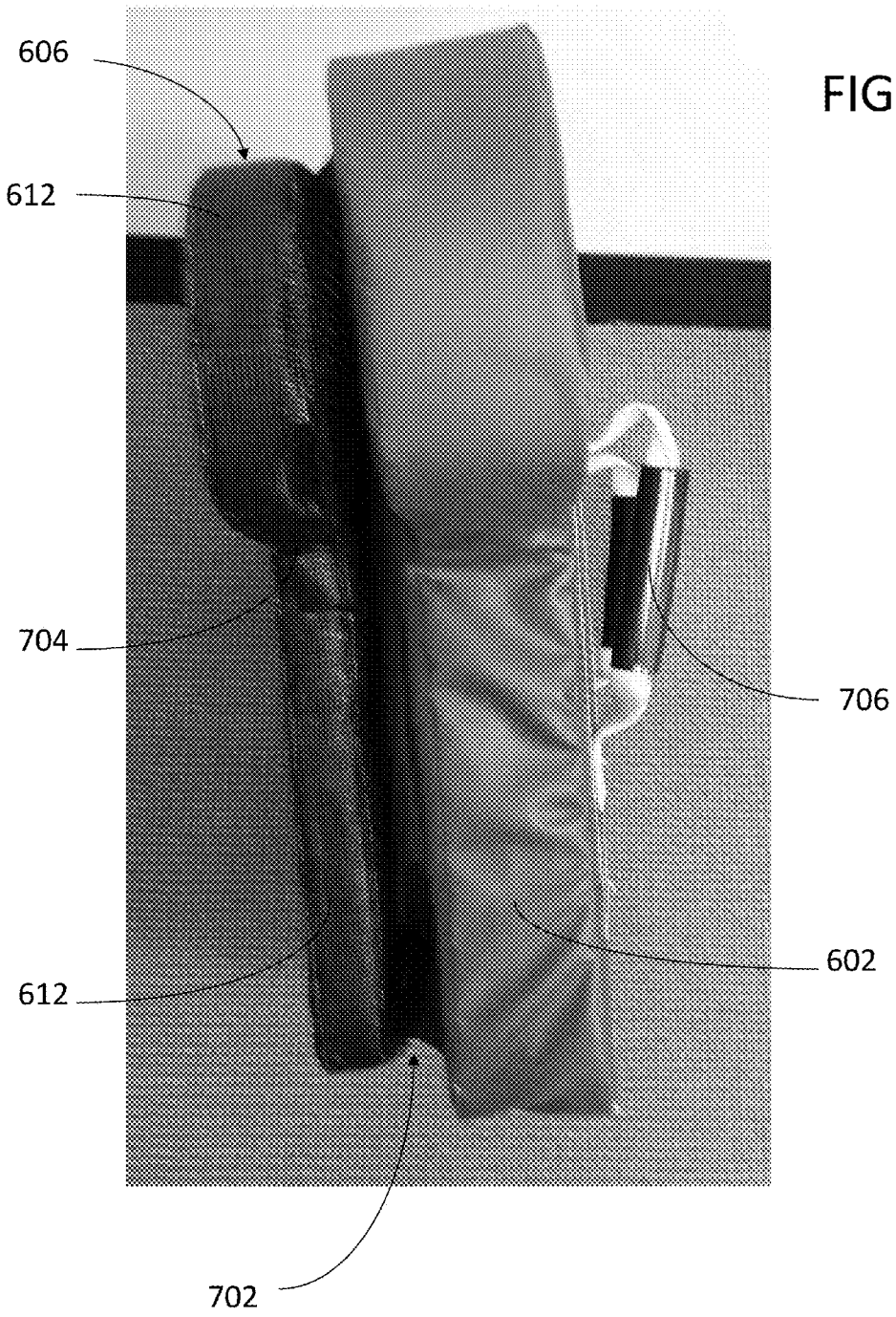
FIG. 7 illustrates a side view of an embodiment of the training apparatus according to the present disclosure.
Figure 8:
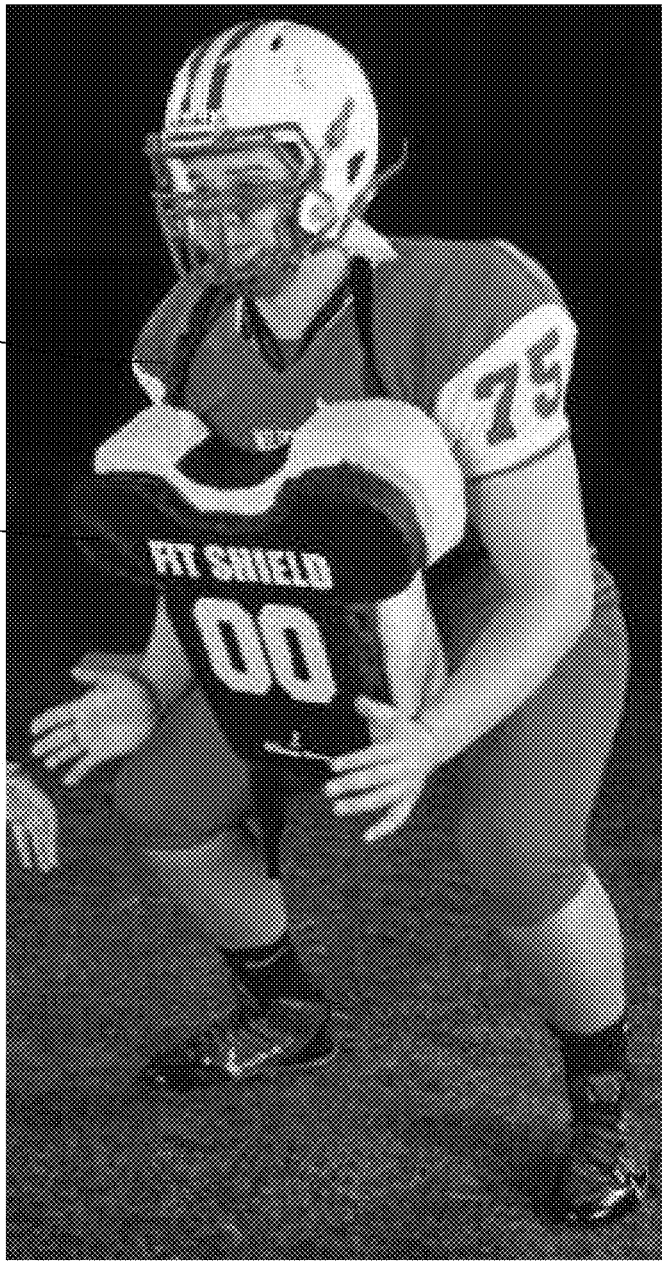
FIG. 8 illustrates a football player wearing an embodiment of the training apparatus according to the present disclosure.

FIG. 7 is a side view of the Fit Shield device 600 according to an embodiment of the present disclosure. In this view exemplary thickness dimensions of the base pad 602 and the outer pad 606 and a crease area 702 between the pads can be discerned. In some embodiments, the thickness of the foam layer of the base pad 102 can be set to provide a base pad thickness of approximately 2.5 to 6.0 inches. The outer pad 106 typically has a smaller thickness of approximately 0.05 to 3 inches, to mimic a thickness of a football jersey, for example. In some embodiments, the covering of the outer pad 608 is stitched to the covering 604 of the base pad so as to form a crease 702. In a Mocking or tackling exercise, the crease 702 enables a player to curl their fingers around the back of the outer pad for gripping. In some embodiments, the crease 702 may be between 0.75 and 3.25 inches in thickness, providing sufficient space for players to curl their fingers around the back of the outer pad 606. FIG. 7 also provides a clear view of the target armpit region 704 formed at the intersection between the torso region 610 and shoulder region 614. As also shown in FIG. 7, hand grips and/or straps 706 are coupled to the back of base pad 602, e.g., by stitching. The hand grips or straps enable a player to hold the Fit Shield device 600 in front of himself and to participate in training sessions wearing the target for blocking/tackling exercises. FIG. 8 illustrates a football player wearing a Fit Shield device 600 according to an embodiment of the present disclosure on the front of his torso. In the exemplary illustration shown, the Fit Shield device includes straps 802 that fit around the player's neck allowing the player to be securely fastened to the Fit Shield device. One of the advantages of using the Fit Shield device according to the present disclosure is that, as can be discerned in FIG. 8, the hands of the player wearing the Fit Shield device are free; in practices in which facing players attempt to perform blocks or tackles using the Fit Shield device as a target, the player wearing the Fit Shield device is free to push back, attempt to perform a similar block on the facing player, etc., providing an additional, realistic dimension to blocking/tackling practice.

Figure 9:
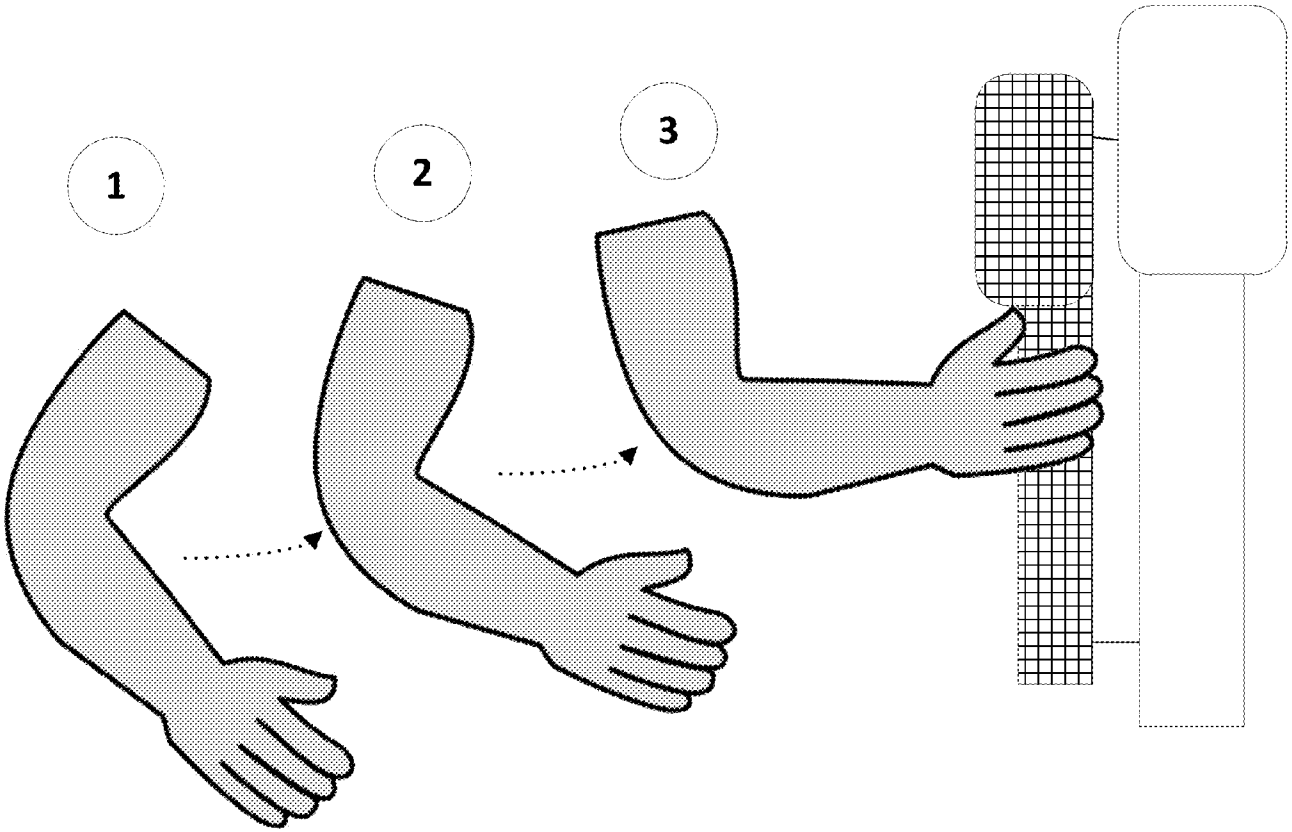
FIG. 9 illustrates a blocking or tackling maneuver which the apparatus of the present disclosure is adapted for training.

FIG. 9 is a series illustration showing a shoot-up block/tackle maneuver which is among the techniques which the training apparatus of the present disclosure are particularly adapted to help teach. As shown, at a first step (1) a player may be several feet away from the target in a crouched position with his hands pointed an angle between a downward and even (toward the target) orientation. In step (2), the player is trained to bring his arms/hands up with thumbs pointing upward as he advances toward the target. At step (3), the player has advanced to the target and his hands are in position to grab the outer pad of the training apparatus near the armpit region. Although not in the view depicted, the player is trained to position his arms/hands fairly close together so that his hands grab the opposite sides of the torso region of the target, which, as noted above, may be set between 8 and 12 inches wide.

Figure 10:
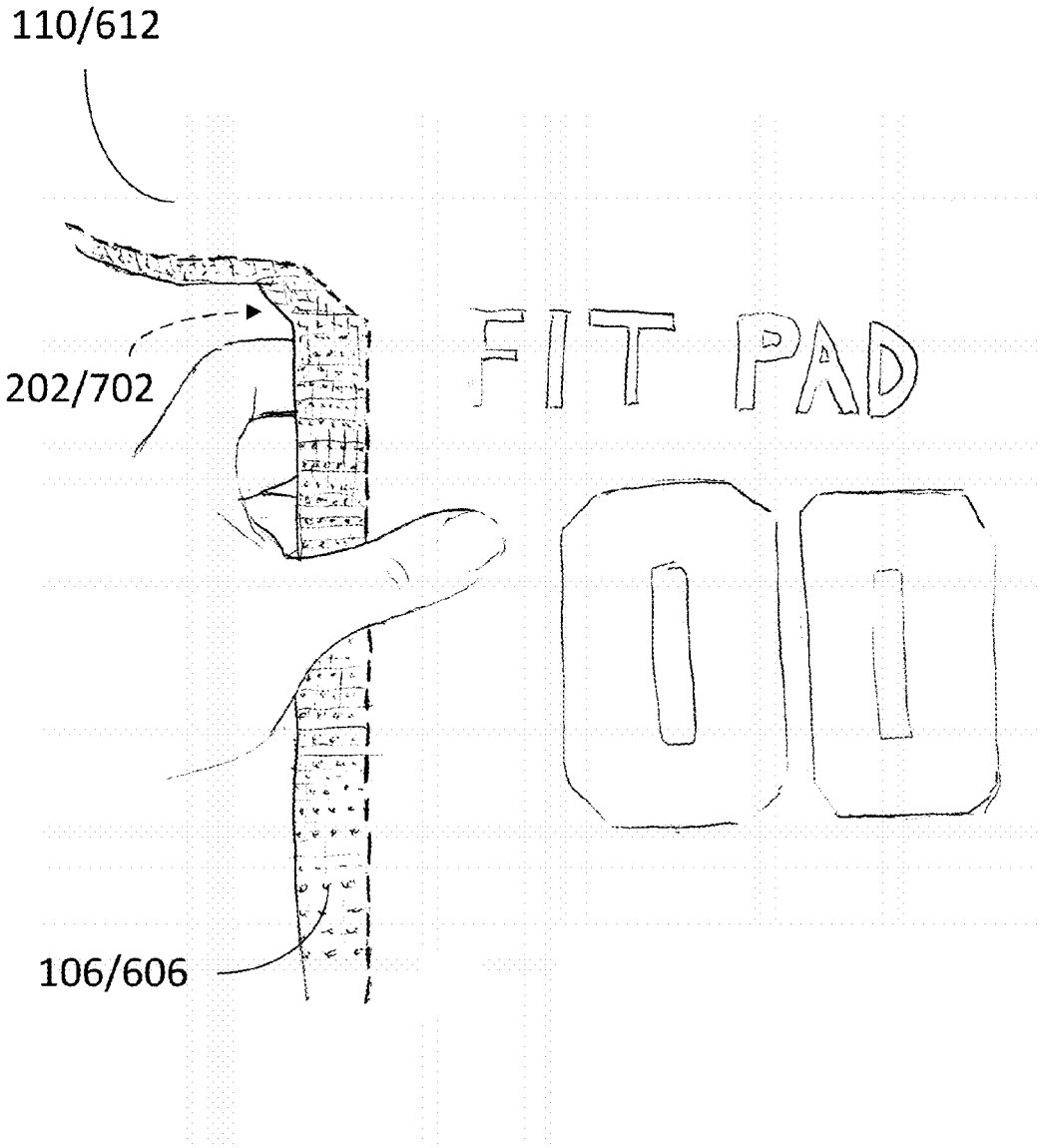
FIG. 10 illustrates a player's hand in position to grab an outer pad of a training apparatus according to the present disclosure.

FIG. 10 is an illustration of a player grabbing an outer pad 106/606 of a training apparatus according to an embodiment of the present disclosure. As shown, a player's thumb comes into contact with the front of the outer pad 106/606 while the player's forefingers curl around the back of the outer pad into the crease 202/702 between the outer pad 106/606 and the base pad (not shown). With thumb and forefingers in opposition around the outer pad 106/606, the player can get a good grip on the outer pad 106/606, which is aided by the friction of the mesh material with which the outer pad is preferably covered. Moreover, if the player moves his hand any higher than depicted, it would be blocked by the shoulder region 110/612, and in this relatively locked position, even more force could be applied to the outer pad 106/606, enabling an effective blocking or tackling maneuver.

The disclosed embodiments may be configured in other specific forms without departing from the spirit or essential characteristics identified herein. The embodiments are in all respects only as illustrative and not as restrictive. The scope of the embodiments is, therefore, indicated by the appended claims and their combination in whole or in part rather than by the foregoing description. All changes that come within the meaning and range of equivalency of the claims are to be embraced within their scope.

I claim:

1. A training apparatus for developing fundamental skills for the game of football, comprising:

a base pad having at least one of a hand grip and a shoulder strap; and an outer pad mounted and securely stitched to a front of the base pad, the outer pad having a torso region and a shoulder region shaped to mimic shoulder pads of a football player;

wherein the outer pad is covered with a grippable mesh material adapted to mimic a texture and form of a football jersey and is smaller than and fits within a perimeter of the front of the base pad, and during training, is adapted to draw attention to the center of the training apparatus and to draw hands of a training player inside the perimeter of the base pad and wherein there is a gap between the outer pad and the base pad extending from the shoulder region of the outer pad to a vicinity of the bottom of the torso of the outer pad, the gap adapted to enable a football player to firmly grip the outer pad.

2. The training apparatus of claim 1, wherein the base pad includes an internal slot adapted to enable the base pad to fit onto a training sled.

3. The training apparatus of claim 2, wherein the internal slot is adapted to enable the base pad to fit onto a flat leaf spring.

4. The training apparatus of claim 2, wherein the base pad includes handles and is adapted for use as either a stand up dummy on a training sled or as a hand shield worn by a football player.

5. The training apparatus of claim 1, wherein the mesh material covering the outer pad has high tensile strength and abrasion resistance.

6. The training apparatus of claim 5, wherein the mesh material covering the outer pad has high ultraviolet light resistance.

7. The training apparatus of claim 1, wherein the outer pad includes a non-absorbent foam impervious to moisture.

8. The training apparatus of claim 7, wherein the non-absorbent foam comprises a closed cell polyurethane foam.

9. The training apparatus of claim 1, wherein a top and a bottom of the outer pad is securely fastened to the base pad.

10. The training apparatus of claim 1, wherein the outer pad is approximately 0.05 to 3.0 inches in thickness.

11. The training apparatus of claim 1, wherein the base pad includes a high density polyurethane foam resistant to deformation.

12. The training apparatus of claim 1, wherein the base pad is approximately 3 to 6 inches in thickness.

13. The training apparatus of claim 1, wherein the shape of the outer pad provides a grip location in an armpit region at an intersection of the torso and shoulder regions for application of leverage.

14. The training apparatus of claim 1, wherein the mesh material covering the outer pad includes printed numbers to mimic an appearance of a football jersey.

15. The training apparatus of claim 1, wherein gaps in the mesh material covering the outer pad enable air-drying of the outer pad.

16. The training apparatus of claim 1, wherein the outer pad includes visual landmarks including at least one of a jersey number, an armpit region, a narrow torso, deltoids and a shoulder epaulet.

* * * * *